US011047236B2

(12) United States Patent
Chen et al.

(10) Patent No.: US 11,047,236 B2
(45) Date of Patent: Jun. 29, 2021

(54) FILLING MINING METHOD FOR FULLY-MECHANIZED TOP COAL CAVING WORKING FACE

(71) Applicant: SHANDONG UNIVERSITY OF SCIENCE AND TECHNOLOGY, Qingdao (CN)

(72) Inventors: Shaojie Chen, Qingdao (CN); Zhaowen Du, Qingdao (CN); Zhiguo Xia, Qingdao (CN); Zhen Zhang, Qingdao (CN); Bing Chen, Qingdao (CN); Zhiyuan Li, Qingdao (CN); Yong Jian, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 16/622,263

(22) PCT Filed: Dec. 25, 2018

(86) PCT No.: PCT/CN2018/123655

§ 371 (c)(1),
(2) Date: Dec. 12, 2019

(87) PCT Pub. No.: WO2020/098089

PCT Pub. Date: May 22, 2020

(65) Prior Publication Data

US 2021/0040850 A1 Feb. 11, 2021

(30) Foreign Application Priority Data

Nov. 15, 2018 (CN) ..... 201811357304.8

(51) Int. Cl.
*E21F 15/08* (2006.01)
*E21C 41/18* (2006.01)
*E21F 15/02* (2006.01)

(52) U.S. Cl.
CPC ..... *E21F 15/08* (2013.01); *E21C 41/18* (2013.01); *E21F 15/02* (2013.01)

(58) Field of Classification Search
CPC ..... E21C 41/18; E21C 41/16; E21F 15/02; E21F 15/08; E21D 23/0481
See application file for complete search history.

(56) References Cited

U.S. PATENT DOCUMENTS 4,198,097 A * 4/1980 Fondriest ..... E21C 41/18 299/11
4,219,237 A * 8/1980 Sisemore ..... E21B 33/13 299/11

(Continued)

FOREIGN PATENT DOCUMENTS

CN 107939401 A 4/2018

OTHER PUBLICATIONS

International Search Report issued in corresponding International Application No. PCT/CN2018/123655, dated May 27, 2019, State Intellectual Property Office of the P.R. China, Beijing, China.

(Continued)

*Primary Examiner* — Carib A Oquendo
(74) *Attorney, Agent, or Firm* — Hauptman Ham, LLP

(57) ABSTRACT

Provided is a filling mining method for a fully-mechanized top coal caving working face, which relates to the field of mining engineering technologies. The method solves the technical problems of roof control of the fully-mechanized top coal caving working face and a large ground deformation of top coal caving mining. The method includes the following steps: at step A, dividing the fully-mechanized top coal caving working face into a filling zone and a top coal caving zone along a strike of the working face, or dividing the working face into a filling zone and a top coal caving zone along a strike and an inclination of the working face; at step B, determining a cycle interval of the working face; at step C, performing supporting for the filling zone before the working face, and completing coal caving in the top coal caving zone and performing round wood supporting in the filling zone; at step D, after the filling zone reaches the filling interval, disposing a filling tarpaulin behind a hydraulic support and pumping the filling paste; at step E, repeating (Continued)

steps C and D to complete mining. A mining method of alternate coal caving and filling is provided to complete the filling mining of the top coal caving working face. In this way, the roof is effectively controlled, ground subsidence is reduced and advantages such as safety and high efficiency are available.

14 Claims, 3 Drawing Sheets

(56) References Cited

U.S. PATENT DOCUMENTS 5,425,601 A * 6/1995 Calandra, Jr. ..... E21C 41/16 405/259.1
2003/0168903 A1* 9/2003 Fourie ..... E21C 41/16 299/11
2007/0170771 A1* 7/2007 Cavinder ..... E21F 1/14 299/19
2011/0006586 A1* 1/2011 Holme ..... E21D 23/0017 299/33
2016/0102553 A1* 4/2016 Zhang ..... E21F 15/02 299/11
2016/0305245 A1* 10/2016 Ma ..... E21F 15/00
2017/0248017 A1* 8/2017 MacDonald ..... E21B 7/046
2019/0301283 A1* 10/2019 Zhang ..... E21F 15/00

OTHER PUBLICATIONS

Written Opinion issued in corresponding International Application No. PCT/CN2018/123655, dated May 27, 2019, State Intellectual Property Office of the P.R. China, Beijing, China.
Chinese Search Report issued in corresponding Chinese Patent Application No. 201811357304.8, dated Apr. 20, 2019.
First Office Action issued in corresponding Chinese Patent Application No. 201811357304.8, dated Apr. 28, 2019.

* cited by examiner

FILLING MINING METHOD FOR FULLY-MECHANIZED TOP COAL CAVING WORKING FACE

RELATED APPLICATIONS

The present application is a National Phase of International Application Number PCT/CN2018/123655, filed Dec. 25, 2018, and claims the priority of Chinese Application No. 201811357304.8, filed Nov. 15, 2018.

TECHNICAL FIELD

The present disclosure relates to the field of mining engineering technologies, and in particular to a zoned coal caving and filling mining method for a fully-mechanized top coal caving working face.

BACKGROUND

At present, during a fully-mechanized top coal caving mining process, a roof of a gob is treated with a caving method. The roof caving may result in subsidence of ground surface which may bring damages to structures, ground traffic facilities and surface water in a case of mining of coal seam of a large thickness. At the same time, a large number of piles of gangues produced by the top coal caving mining will cause environmental pollution. The filling mining method is an effective method to solve the problem of ground subsidence. Especially, the gangue filling technique can not only digest the gangues but also effectively reduce the ground subsidence. However, since circumstances that top coals cave down during the fully-mechanized top coal caving mining and a mine pressure of a gob behaves and so on are complex, a space for implementation of filling is small and the filling is difficult to perform. Therefore, the filling of the fully-mechanized top coal caving working face requires a mining method to be entirely designed so as to propose a filling mining method applicable to the fully-mechanized top coal caving working face.

SUMMARY

To solve the technical problems of a roof control of a fully-mechanized top coal caving working face and a large ground deformation of top coal caving mining, the present disclosure provides a filling mining method for a fully-mechanized top coal caving working face. The specific technical solution is described below.

A filling mining method for a fully-mechanized top coal caving working face includes the following steps.

At step A, the fully-mechanized top coal caving working face is divided into a filling zone and a top coal caving zone along a strike of the working face. Lengths of the filling zone and the top coal caving zone are equal to a strike length of the working face, a sum of widths of the filling zone and the top coal caving zone is equal to a width of the working face, and the filling zone is adjacent to the top coal caving zone.

At step B, a cycle interval of the working face is determined.

At step C, the filling zone divided at step A is supported before the fully-mechanized top coal caving working face to complete advancing and pushing procedures, coal caving is completed in the top coal caving zone and a round wood supporting is performed in the filling zone.

At step D, after the filling zone reaches a filling interval, a filling tarpaulin is provided behind the hydraulic support, and filling paste is pumped to the filling zone.

At step E, the steps C and D are repeated to complete the filling mining of the fully-mechanized top coal caving working face.

A filling mining method for a fully-mechanized top coal caving working face includes the following steps.

At step A, the fully-mechanized top coal caving working face is divided into a filling zone and a top coal caving zone along a strike and an inclination of the working face. The filling zone and the top coal caving zone are of rectangular shape and are staggeredly arranged. A plurality of filling zones and top coal caving zones are divided along the strike and the inclination of the working face respectively. The filling zone is adjacent to the top coal caving zone.

At step B, a cycle interval of the working face is determined.

At step C, the filling zone divided at step A is supported before the fully-mechanized top coal caving working face to complete advancing and pushing procedures, coal caving is completed in the top coal caving zone and round wood supporting is performed in the filling zone.

At step D, after the filling zone reaches a filling interval, a filling tarpaulin is provided behind the hydraulic support, so that filling paste is pumped to the filling zone.

At step E, when the working face is pushed from the top coal caving zone to the filling zone, supporting is performed before the fully-mechanized top coal caving working face, and a round wood support is erected behind the working face and the step D is repeated; when the working face is pushed from the filling zone to the top coal caving zone, step D is completed in the filling zone and then advancing and pushing procedures are completed and coal caving is completed in the top coal caving zone; along with the advance of the working face, the filling zone and the top coal caving zone are staggeredly arranged to complete the filling mining of the fully-mechanized top coal caving working face.

Preferably, the fully-mechanized top coal caving working face is arranged in a hard coal seam of uniform thickness. A length and a width of the top coal caving zone are both smaller than a first weighting interval of a main roof.

Preferably, a cycle interval of the working face is specifically determined based on a daily advance distance of the fully-mechanized top coal caving working face.

Preferably, supporting includes combined supporting provided with a bolt, a cable and a mesh, and the round wood supporting includes round wood supporting formed by columns and beams uniformly arranged.

Preferably, the fully-mechanized top coal caving working face is supported by a fully-mechanized hydraulic support and two rear supporting beams are provided behind the fully-mechanized hydraulic support.

Further preferably, the rear supporting beam and the rear of the fully-mechanized hydraulic support are fixedly hinged, and a rear end of the rear supporting beam protrudes above a filler.

Further preferably, filling paste contains an expanding agent which is calcium sulphoaluminate expanding agent. The expanding agent contains ettringite.

The present disclosure has the following beneficial effects.

(1) The fully-mechanized top coal caving working face is divided into a plurality of filling zones and top coal caving zones. The filling zone and the top coal caving zone are adjacently arranged to effectively control subsidence of the roof and reduce ground subsidence. In addition, the staggered arrangement of the filling zone and the top coal caving zone further divides the filling zone and the top coal caving zone, which helps to form a triangular roof control structure, thereby realizing higher stability.

(2) Supporting is performed firstly with a structure of a bolt, a cable and a mesh in the filling zone, and then round wood supporting is provided behind the fully-mechanized hydraulic support. Thus, it is guaranteed that a stable, effective and safe filling space is formed in the gob. In this case, the filling paste is isolated in the filling zone by the filling tarpaulin. With staggered arrangement of the filling zone and the top coal caving zone, a staggered filling zone is formed so that filling and supporting effect can be enhanced further.

(3) To adapt to the filling mining method, a rear supporting beam is provided behind the fully-mechanized hydraulic support to facilitate standardized operation and ensure high construction safety. In particular, when the filling zone and the top coal caving zone are staggeredly arranged, the construction safety of the top coal caving at the time of changing the working face from the filling zone to the top coal caving zone is guaranteed.

(4) The expanding agent is added into the filling paste so that the filling paste increases in volume after solidification. The filling zone expands to a non-filling zone on both sides so that a density of the non-filling zone containing floating coals and broken gangues is increased, thereby effectively increasing a filling rate and a roof control capability of the gob.

Figure 1:
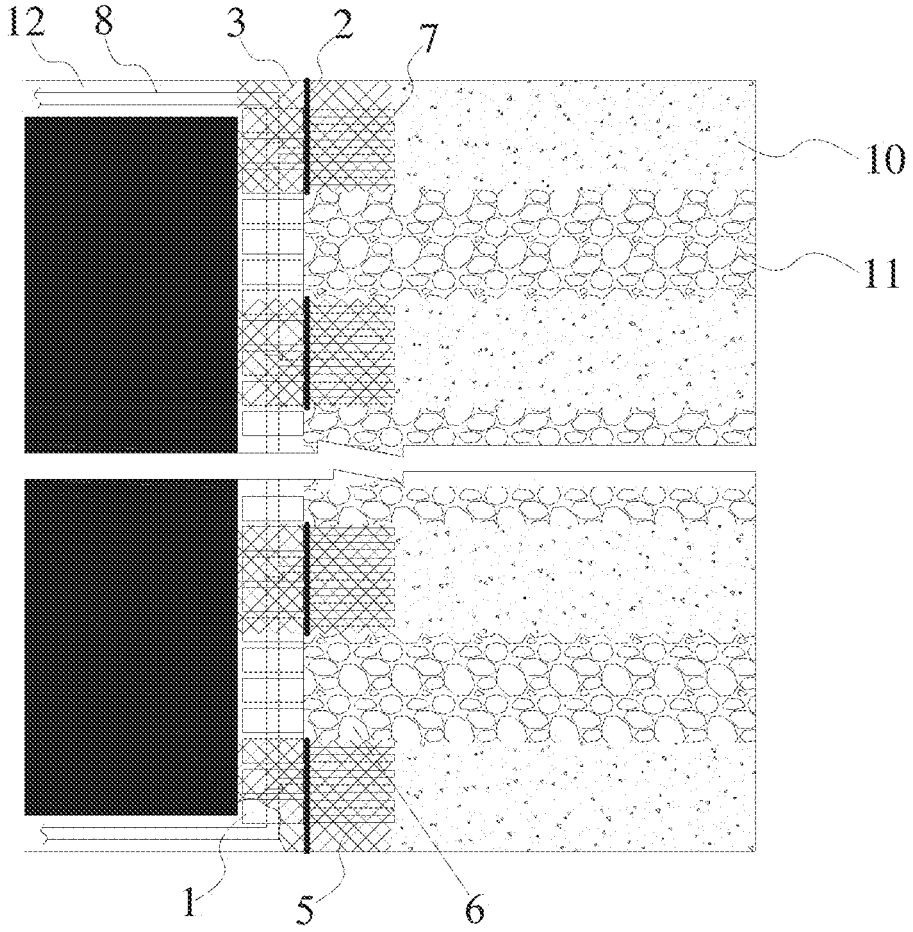
FIG. 1 is a schematic diagram illustrating a division of a filling zone in a filling mining method of a fully-mechanized top coal caving working face.

In the drawings, numerals are described as follows: 1—fully-mechanized hydraulic support, 2—filling tarpaulin, 3—a mesh, 4—a bolt, 5—filling zone, 6—top coal caving zone, 7—rear supporting beam 8—filling pipe, 9—top coal, 10—filler, 11—gob, and 12—crossheading.

DETAILED DESCRIPTION OF THE EMBODIMENTS

In combination with FIGS. 1-4, the present disclosure provides a filling mining method for a fully-mechanized top coal caving working face. The specific implementation is described below.

Example 1

Figure 3:
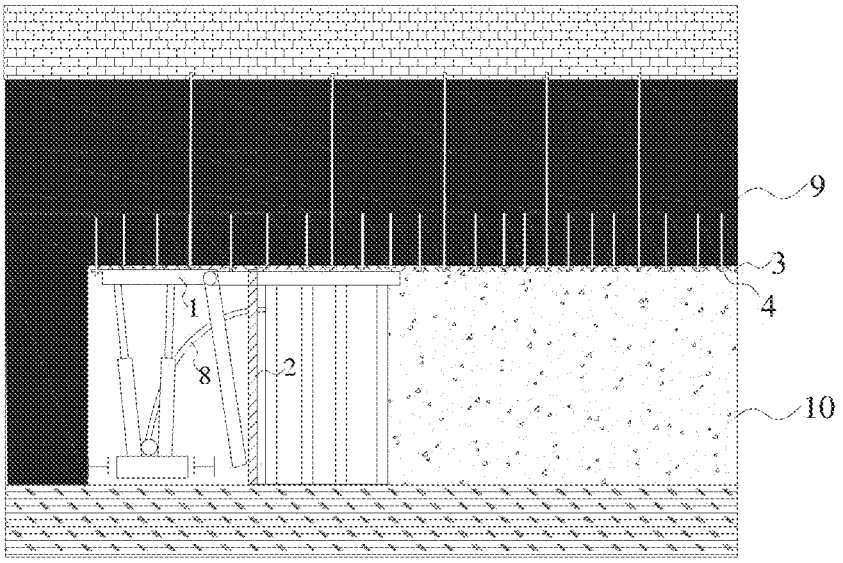
FIG. 3 is a schematic diagram illustrating a section of a supporting structure of the working face of FIG. 1.

As shown in FIGS. 1 and 3, a filling mining method for a fully-mechanized top coal caving working face includes the following specific steps.

At step A, when the fully-mechanized top coal caving working face is arranged in a hard coal seam of uniform thickness and there is no large fault in the working face, the fully-mechanized top coal caving working face is divided into a filling zone 5 and a top coal caving zone 6 along a strike of the working face. Lengths of the filling zone 5 and the top coal caving zone 6 are equal to a strike length of the working face, a sum of widths of the filling zone 5 and the top coal caving zone 6 is equal to the width of the working face and it is guaranteed that the length and the width of the top coal caving zone are both smaller than a first weighting interval of a main roof. The filling zone 5 is adjacent to the top coal caving zone 6. The fully-mechanized top coal caving working face is divided into a plurality of filling zones 5 and top coal caving zones 6 and the filling zone 5 and the top coal caving zone 6 are adjacently arranged in a strip shape. In this way, a top coal caving area is reduced, and subsidence of the roof is controlled effectively, thereby reducing ground subsidence.

At step B, a cycle interval of the fully-mechanized top coal caving working face is determined. A motion parameter of an immediate roof is calculated based on a sum of weightings of the working face, and the cycle interval of the working face is specifically determined according to a daily advance distance of the fully-mechanized top coal caving working face.

At step C, the filling zone divided at step A is supported before the fully-mechanized top coal caving working face. The supporting includes a combined supporting roof with a bolt 4, a cable and a mesh 3 at a roof position before a fully-mechanized hydraulic support 1. In this period, disposal distance of the bolt and the cable may be adjusted according to a roof separation situation of the top coal caving zone mining. Further, the supporting may be carried out only with the bolt and the mesh. When the supporting effect of the bolt and the cable cannot satisfy requirements, the cable may be added for supporting. The advancing and pushing procedures are completed and coal caving is completed in the top coal caving zone 6. Round wood supporting is performed in the filling zone 5, and the round wood supporting is achieved by arranging round woods uniformly and densely in the filling zone. In addition, when the fully-mechanized hydraulic support is selected, the fully-mechanized hydraulic support of the filling zone may not have the function of coal caving provided that the filling is facilitated. Since the fully-mechanized hydraulic support of the top coal caving zone has the function of coal caving, the fully-mechanized top coal caving hydraulic support may be selected.

At step D, after the filling zone 5 reaches a filling interval, a filling tarpaulin 2 is provided behind the fully-mechanized hydraulic support 1, the filling tarpaulin 2 separates the filling zone 5 from the zone of the working face support, and a filling pipe 8 pumps filling paste to the filling zone 5. The filling pipe 8 is arranged in a crossheading 12 and reaches different filling positions by passing below the working face hydraulic support. The filling paste is delivered to a zone to be filled through an inlet above the filling tarpaulin 2. When the filling tarpaulin 2 is provided, it is required to ensure that a height of the filling tarpaulin 2 is greater than a filling height and a bottom edge of the filling tarpaulin 2 is in close contact with the roof. An expanding agent is added in the filling paste so that a filler 10 increases in volume after the filling paste solidifies. The filling zone 5 expands to the top coal caving zone 6 on both sides so that the a density of a gob of the top coal caving zone 6 containing floating coals and broken gangues increases, thereby effectively increasing the filling rate and the roof control capability of the gob 11. The expanding agent is calcium sulphoaluminate expanding agent. The expanding agent contains ettringite. The expanding agent is mainly made with gypsum and aluminum ore through calcination. The filling paste selects a combination of calcium sulphoaluminate expanding agent, cement, coal ash and gangue with their mass ratio being 0.5:1:4:6.

At step E, the steps C and D are repeated. The adoption of the mesh, the cable and the bolt is continued for supporting before the fully-mechanized top coal caving working face of the filling zone 5 and adoption of the dense round wood supporting is continued after the fully-mechanized top coal caving working face. In this way, filling is performed after the filling interval is reached. The roof may be pre-fractured in the top coal caving zone 6 to facilitate coal caving. In this period, consistent operations of advancing and pushing in the filling zone and the top coal caving zone are maintained to ensure the working face is pushed continuously. Thus, the filling mining of the fully-mechanized top coal caving working face is completed. The round wood may be a structure of two columns and one beam and a reliable construction space is formed after the round wood is disposed. In addition, in a location of large mining pressure, a single hydraulic supporting column may also be selected to replace the round wood for supporting. Since the filling zone 5 and the top coal caving zone 6 are adjacent to each other and arranged in a strip shape, standardized operation is facilitated. Further, the filling zone is continuous and helpful to arrangement of the filling pipes.

Figure 2:
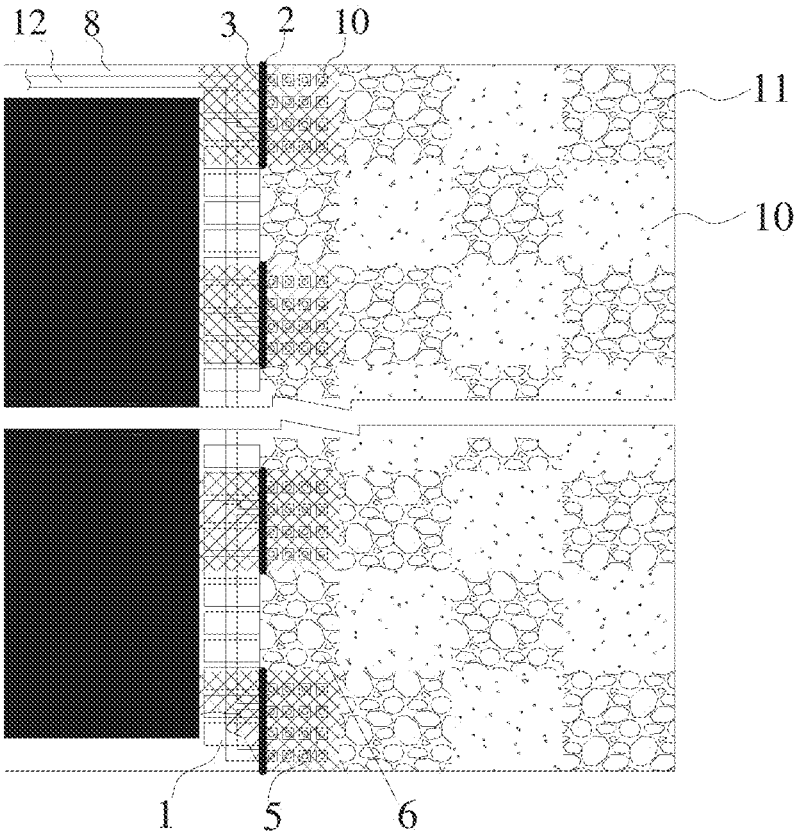
FIG. 2 is a schematic diagram illustrating a staggered division of a filling zone in a filling mining method of a fully-mechanized top coal caving working face.
Figure 4:
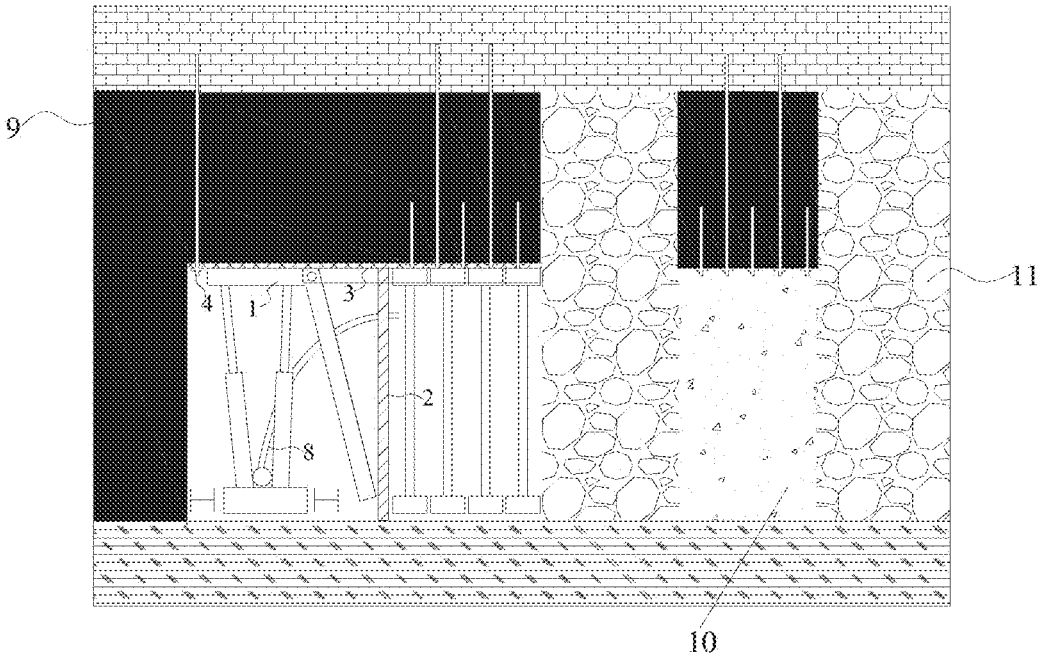
FIG. 4 is a schematic diagram illustrating a section of a supporting structure of the working face of FIG. 2.

As shown FIGS. 2 and 4, when the filling zone and the top coal caving zone are staggeredly arranged, the filling mining method for the fully-mechanized top coal caving working face includes the following steps.

At step A, when the fully-mechanized top coal caving working face is arranged in a hard coal seam of uniform thickness and there is no large fault in the working face, the fully-mechanized top coal caving working face is divided into a filling zone 5 and a top coal caving zone 6 along a strike of the working face. The filling zone 5 and the top coal caving zone 6 are of rectangular shape and arranged staggeredly. A plurality of filling zones 5 and top coal caving zones 6 are divided respectively along a strike and an inclination of the working face. A length and a width of the top coal caving zone 6 are smaller than a first weighting interval of a main roof to ensure caving safety. The filling zone is adjacent to the top coal caving zone. With staggered arrangement of the filling zone and the top coal caving zone, staggered filling zones are formed to further reduce continuous caving area of the roof and increase the filling and supporting effects.

At step B, a cycle interval of the fully-mechanized top coal caving working face is determined. A motion parameter of an immediate roof is calculated based on a sum of weightings of the working face, and the cycle interval of the working face is specifically determined according to a daily advance distance of the fully-mechanized top coal caving working face.

At step C, the filling zone 5 divided at step A is supported before the fully-mechanized top coal caving working face. The supporting includes a combined supporting with a bolt 4, a cable and a mesh 3. The advancing and pushing procedures are completed and coal caving is completed in the top coal caving zone 6 and round wood supporting is performed in the filling zone. The round wood supporting is performed by arranging round woods densely and uniformly in the filling zone. Further, a fully-mechanized hydraulic support 1 is adopted by the fully-mechanized top coal caving working face for supporting. Two rear supporting beams 2 are provided behind the fully-mechanized hydraulic support 1 so that simple supporting can be performed for the filling zone 5. The rear supporting beam 7 is fixedly hinged with the rear of the fully-mechanized hydraulic support 1 to facilitate advancing and provide operation space for the round wood supporting. A rear end of the rear supporting beam 7 protrudes above the filler 10 for temporary fixing. In a case of advancing, the rear supporting beam 7 is pulled out from the filler 10.

At step D, after the filling zone reaches the filling interval, a filling tarpaulin 2 is provided behind the fully-mechanized hydraulic support 1. The filling paste is pumped to the filling zone through a filling pipe 8 and an expanding agent is added in the filling paste. In a case of filling, the paste is filled from down to up and solidified firmly. The expanding agent is added so that the filling paste increases in volume after solidification. The filling zone expands to the top coal caving zones 6 on both sides and at front and back so that the a density of a gob 11 of the adjacent top coal caving zone containing floating coals and broken gangues increases, thereby effectively increasing the filling rate and the roof control capability of the gob 11.

At step E, when the working face is pushed from the top coal caving zone to the filling zone 5, supporting is performed before the fully-mechanized top coal caving working face, round wood supporting is performed after the working face and step D is repeated; when the working face is pushed from the filling zone 5 to the top coal caving zone 6, after step D is completed in the filling zone 5, the advancing and pushing procedures are completed and coal caving is completed in the top coal caving zone 6. Specifically, along with advance of the working face, the filling zone and the top coal caving zone are staggeredly arranged to complete filling mining of the fully-mechanized top coal caving working face. Specifically, after the filling zone reaches a boundary of the filling zone divided at step A, a change is made to the top coal caving zone 6 before the filling zone 5. Therefore, coal caving is performed before the filling zone 5. After the fully-mechanized hydraulic support 1 of the top coal caving zone 6 is pushed to a boundary of the top coal caving zone 6, adoption of the mesh 3, the cable and the rod 4 is continued before the fully-mechanized hydraulic support 1 for supporting, and dense round wood supporting is continued after the fully-mechanized hydraulic support 1. After the filling interval is reached, the filling is performed. Alternate coal caving and filling operations are carried out based on the above steps to complete the filling mining of the fully-mechanized top coal caving working face. During the advancing process of the working face, consistent operations of advancing and pushing in the filling zone and the top coal caving zone are maintained to ensure the working face is pushed continuously. Thus, the filling mining of the fully-mechanized top coal caving working face is completed.

Example 2

Based on the example 1, the filling mining method for the fully-mechanized top coal caving working face is described further in combination with engineering instances. A down-hole elevation of a fully-mechanized top coal caving working face of a mine is −241.3 m, and a main coal mining seam is Shanxi Group 3 coal seam. The 3 coal seam is simple in structure and large in thickness, and has no branching phenomenon, therefore, the coal seam level is stable. A strike length of the working face is 700 m, an inclination length is 150 m, the coal seam thickness averages at 8.5 m with a dip angle of 5-8° and the unit weight is 1.38 t/m$^3$. The immediate roof is dark gray siltstone with a general stable thickness being 2-3 m and a compressive strength is 40.53-62.81 MPa. The main roof is a thick-layer medium-particle sandrock with a thickness of 10-30 m. The rock layer is hard and the compressive strength is 91.20-131.7 MPa.

At step A, according to the geological condition and surrounding rock properties of the above mine, it is determined that the width of the top coal caving zone 6 is 10 m and the width of the filling zone 5 is 15 m. According to the length 150 m of the working face, the working face is divided into six top coal caving zones and six filling zones alternately along an inclination.

At step B, a cycle filling interval L is determined as 3 m according to existing production technical conditions of the mine and the motion parameters of the immediate roof of the adjacent fully-mechanized top coal caving working face.

At step C, a metal mesh 3 of 5×1.0 m is paved by overlapping before the fully-mechanized hydraulic support 1 of the working face in the filling zone, with the overlapping length of meshes being 500 mm. The overlapping connection is made with a standard mesh buckle every 0.2 m on the overlapping position. After the metal mesh 3 is paved in the filling zone 5, supporting is enhanced by further hammering bolts in the filling zone 5. After advancing and pushing procedures are completed for the working face, normal top coal caving is performed in the top coal caving zone and no top coal caving is performed for the filling zone 5 and supporting is carried out. Dense supporting is performed by hammering round woods row by row along with the advance of the fully-mechanized hydraulic support 1 in the protection zone of the rear supporting beam 7 behind the fully-mechanized hydraulic support 1 within the filling zone 5.

At step D, after the filling interval L is reached, filling tarpaulins are provided behind the hydraulic supports of the zones to be filled in sequence along the inclination of the working face to form a closed filling space. After the filling tarpaulin 2 is disposed, gangue paste prepared by a ground filling station is pumped to the filling zone for filling through the filling pipe 8 in the working face.

At step E, adoption of the mesh 3, the cable and the bolt 4 is continued before the fully-mechanized hydraulic support 1 of the filling zone 5 for supporting and adoption of dense round wood supporting is continued after the fully-mechanized hydraulic support 1. After the filling interval is reached, the filling is performed. The roof may be pre-fractured in the top coal caving zone to facilitate coal caving. In this period, consistent operations of advancing and pushing in the filling zone 5 and the top coal caving zone 6 are maintained to ensure the working face is pushed continuously. Thus, the filling mining of the fully-mechanized top coal caving working face is completed.

Example 3

Based on the example 1, the filling mining method for the fully-mechanized top coal caving working face is described further in combination with engineering instances. A strike length of a fully-mechanized top coal caving working face of a mine is 800 m, and an inclination length is 200 m. The coal seam thickness of the working face averages at 9 m and the coal seam belongs to a stable coal seam. The dip angle of the coal seam averages at 9°. The immediate roof is a mudstone with an average thickness of 1.4 m and the average unidirectional compressive strength is 47.7 MPa. The main roof is fine sandstone with average thickness of 3.0 m and the average unidirectional compressive strength is 119.8 MPa. An immediate floor is a mudstone of average thickness of 2.4 m and the average unidirectional compressive strength is 47.7 MPa. A main floor is fine sandstone of average thickness of 3.9 m and the average unidirectional compressive strength is 119.8 MPa.

At step A, the width of the top coal caving zone is determined as 15 m according to a mining depth 300 m, a mining thickness 3.8 m, a coal caving 5.2 m of a mine, and a first weighting interval 23 m of the main roof, and the width of the filling zone 5 is determined as 25 m through calculation and comparison. Based on the working length 200 m of the working face, the working face is divided into five top coal caving zones and five filling zones staggeredly along an inclination.

At step B, the cycle filling interval L is determined as 3 m according to the daily advance distance 3 m of the fully-mechanized top coal caving working face.

At step C, a metal mesh 3 of 5×1.0 m is paved sequentially by overlapping before the fully-mechanized hydraulic support 1 of the working face in the filling zone 5, with the overlapping length of meshes being 500 mm. The overlapping connection is made with a standard mesh buckle every 0.2 m on the overlapping position. After the metal mesh 3 is paved in the filling zone 5, supporting is enhanced by further hammering bolts in the filling zone 5. After advancing and pushing procedures are completed for the working face, normal top coal caving is performed in the top coal caving zone 6 and no top coal caving is performed for the filling zone 5 and supporting is carried out. Dense supporting is performed by hammering round woods row by row along with mining behind the fully-mechanized hydraulic support 1 within the filling zone 5. In a case of poor round wood supporting effect, a single hydraulic supporting column is selected for supporting.

At step D, after the filling zone 5 reaches the filling interval L, a filling tarpaulin 2 is provided behind the fully-mechanized hydraulic support 1 of the zone to be filled along an inclination of the working face to form a closed filling space. After the filling tarpaulin 2 is disposed, gangue filling paste prepared by a ground filling station is pumped to the filling zone 5 for filling through the filling pipe 8 in the working face. The expanding agent is added in the filling paste. The mass ratio of the expanding agent in the filling paste is calcium sulphoaluminate expanding agent:cement:coal ash:gangue=0.5:1:4:6.

At step E, when the filling reaches the boundary of the filing zone along with advance of the working face, top coal caving is performed alternately. The filling zone 5 and the top coal caving zone 6 are changed within the working face, that is, steps 4 and 5 are repeated with the width of the filling zone 5 being 15 m and the width of the non-filling zone being 10 m to realize mining with filling and top caving staggered. After the mining is completed, it is monitored that the ground deformation is very small, which verifies the effect of controlling the ground subsidence by filling.

Of course, the foregoing descriptions are not intended to limit the present disclosure and the present disclosure is also not limited to the above examples. Changes, modifications, additions and substitutions made by those skilled in the art within the scope of essence of the present disclosure shall all fall within the scope of protection of the present disclosure.

The invention claimed is:

1. A filling mining method for a fully-mechanized top coal caving working face, comprising the following steps:

at step A, dividing the fully-mechanized top coal caving working face into a filling zone and a top coal caving zone along a strike of the working face, wherein lengths of the filling zone and the top coal caving zone are equal to a strike length of the working face, a sum of widths of the filling zone and the top coal caving zone is equal to a width of the working face, and the filling zone is adjacent to the top coal caving zone;

at step B, determining a cycle interval of the working face;

at step C, performing supporting for the filling zone divided at step A before the fully-mechanized top coal caving working face, completing advancing and pushing procedures, completing top coal caving in the top coal caving zone and performing round wood supporting in the filling zone;

at step D, after the filling zone reaches the filling interval, providing a filling tarpaulin behind a hydraulic support and pumping filling paste to the filling zone; and at step E, repeating steps C and D to complete filling mining of the fully-mechanized top coal caving working face.

2. The filling mining method for a fully-mechanized top coal caving working face according to claim 1, wherein the fully-mechanized top coal caving working face is arranged in a hard coal seam of uniform thickness, and a length and a width of the top coal caving zone are smaller than a first weighting interval of a main roof.

3. The filling mining method for a fully-mechanized top coal caving working face according to claim 1, wherein the cycle interval of the working face is specifically determined according to a daily advance distance of the fully-mechanized top coal caving working face.

4. The filling mining method for a fully-mechanized top coal caving working face according to claim 1, wherein the supporting comprises a combined supporting provided with a bolt, a cable and a mesh, and the round wood supporting comprises round wood supporting formed by columns and beams arranged uniformly.

5. The filling mining method for a fully-mechanized top coal caving working face according to claim 1, wherein the fully-mechanized top coal caving working face is supported by a fully-mechanized hydraulic support and two rear supporting beams are provided behind the fully-mechanized hydraulic support.

6. The filling mining method for a fully-mechanized top coal caving working face according to claim 5, wherein the rear supporting beam is fixedly hinged with the rear of the fully-mechanized hydraulic support and a rear end of the rear supporting beam protrudes above a filler.

7. The filling mining method for a fully-mechanized top coal caving working face according to claim 1, wherein the filling paste contains an expanding agent, the expanding agent is calcium sulphoaluminate expanding agent and the expanding agent contains ettringite.

8. A filling mining method for a fully-mechanized top coal caving working face, comprising the following steps:

at step A, dividing a fully-mechanized top coal caving working face into a filling zone and a top coal caving zone along a strike and an inclination, wherein the filling zone and the top coal caving zone are of rectangular shape and are arranged staggeredly, a plurality of filling zones and top coal caving zones are divided along the strike and the inclination of the working face and the filling zone is adjacent to the top coal caving zone;

at step B, determining a cycle interval of the working face;

at step C, performing supporting for the filling zone divided at step A before the fully-mechanized top coal caving working face, completing advancing and pushing procedures as well as coal caving in the top coal caving zone and performing round wood supporting in the filling zone;

at step D, after the filling zone reaches the filling interval, disposing the filling tarpaulin behind the hydraulic support and pumping the filling paste to the filling zone; and at step E, when the working face is pushed from the top coal caving zone to the filling zone, performing supporting before the fully-mechanized top coal caving working face, performing round wood supporting behind the fully-mechanized top coal caving working face and repeating step D; when the working face is pushed from the filling zone to the top coal caving zone, completing step D in the filling zone and then completing advancing and pushing procedures and completing coal caving in the top coal caving zone; along with advance of the working face, arranging the filling zone and the top coal caving zone staggeredly to complete the filling mining of the fully-mechanized top coal caving working face.

9. The filling mining method for a fully-mechanized top coal caving working face according to claim 8, wherein the fully-mechanized top coal caving working face is arranged in a hard coal seam of uniform thickness, and a length and a width of the top coal caving zone are smaller than a first weighting interval of a main roof.

10. The filling mining method for a fully-mechanized top coal caving working face according to claim 8, wherein the cycle interval of the working face is specifically determined according to a daily advance distance of the fully-mechanized top coal caving working face.

11. The filling mining method for a fully-mechanized top coal caving working face according to claim 8, wherein the supporting comprises a combined supporting provided with a bolt, a cable and a mesh, and the round wood supporting comprises round wood supporting formed by columns and beams arranged uniformly.

12. The filling mining method for a fully-mechanized top coal caving working face according to claim 8, wherein the fully-mechanized top coal caving working face is supported by a fully-mechanized hydraulic support and two rear supporting beams are provided behind the fully-mechanized hydraulic support.

13. The filling mining method for a fully-mechanized top coal caving working face according to claim 12, wherein the rear supporting beam is fixedly hinged with the rear of the fully-mechanized hydraulic support and a rear end of the rear supporting beam protrudes above a filler.

14. The filling mining method for a fully-mechanized top coal caving working face according to claim 8, wherein the filling paste contains an expanding agent, the expanding agent is calcium sulphoaluminate expanding agent and the expanding agent contains ettringite.

* * * * *